US005529468A

United States Patent [19]

Tuck, Jr.

[11] Patent Number: 5,529,468

[45] Date of Patent: Jun. 25, 1996

[54] PERISTALTIC PUMP AND DIAPHRAGM THEREFOR

[76] Inventor: Alan D. Tuck, Jr., 5536 Canvasback Rd., Blaine, Wash. 98230

[21] Appl. No.: 449,087

[22] Filed: May 24, 1995

Related U.S. Application Data

[62] Division of Ser. No. 269,249, Jun. 30, 1994, Pat. No. 5,466,133.

[51] Int. Cl.[6] ..... F04C 5/00

[52] U.S. Cl. ..... 418/45; 418/50; 417/474

[58] Field of Search ..... 448/45, 49–51, 448/153; 417/413.1, 474; 92/98 D

[56] References Cited

U.S. PATENT DOCUMENTS

| | | | |
|---|---|---|---|
| 2,636,444 | 4/1953 | Salgues | 418/51 |
| 3,058,428 | 10/1962 | Gemeinhardt | 418/45 |
| 3,194,167 | 7/1965 | Wilson | 418/2 |
| 3,922,119 | 11/1975 | Rosenquist | 418/45 |

FOREIGN PATENT DOCUMENTS

| | | | |
|---|---|---|---|
| 1078447 | 3/1960 | Germany . | |
| 1528971 | 7/1969 | Germany . | |
| 261912 | 5/1970 | U.S.S.R. | 418/45 |
| 579449 | 11/1977 | U.S.S.R. | 417/474 |
| 453807 | 9/1936 | United Kingdom | 417/474 |

*Primary Examiner*—John J. Vrablik
*Attorney, Agent, or Firm*—Lyon & Lyon

[57] ABSTRACT

A peristaltic pump having a shaft mounted within a housing and coupled with a rotor to induce nutation in a wobble plate. A pump diaphragm is located and affixed to one side of the wobble plate and at its periphery to the housing. A backup diaphragm is employed on the other side of the wobble plate and provides a resilient coupling through a driven plate with the rotor. A pump casing associated with the diaphragm defines a pump cavity with the pump diaphragm. An inlet and an outlet having ball check valves or flapper valves control flow. An insert in the pump diaphragm has an oblong minor cross section and is employed to couple with the wobble plate. Mounting elements on the insert extend from one side of the diaphragm which may be formed in the relaxed state and biased inwardly toward one another for mounting to the wobble plate. A boss associated with the diaphragm and a cavity associated with the wobble plate help to further strengthen the diaphragm at the insert. The boss overlies the insert and fits with the cavity to aid in the retention of the diaphragm.

12 Claims, 11 Drawing Sheets

PERISTALTIC PUMP AND DIAPHRAGM THEREFOR

This application is a division of application Ser. No. 08/269,249, filed Jun. 30, 1994, U.S. Pat. No. 5,466,133.

BACKGROUND OF THE INVENTION

The field of the present invention is diaphragm pumps exhibiting a peristaltic motion.

Pumps defining a variable volume chamber by using the space between a pump casing and a diaphragm controlled by a nutating wobble plate have been developed. Reference is made to U.S. Pat. No. 3,058,428 to Gemeinhardt and to U.S. Pat. No. 3,922,119 to Rosenquist. In each instance, a nutating wobble plate driven by a shaft operates to lift away from and then compress against a diaphragm in a wavelike or peristaltic motion. An inlet and an outlet through the pump casing with one-way valves for preventing backflow cooperate with the diaphragm to create an appropriate variable pumping chamber with a peristaltic action.

Such peristaltic pumps place substantial demands on the diaphragms employed. Significant suction and discharge heads contribute to performance and efficiency. Thus, pressure demands in both directions are contemplated on such diaphragms during any single cycle. Complex flexure is also required as the wobble plate nutates. Significant numbers of cycles are required for longevity and economic operation. These demands on the diaphragm are frequently competing. A thin and flexible diaphragm is better able to undergo complex flexure and extended cycling. A thick diaphragm is better able to resist the suction and pressure heads. A thick, more structural diaphragm is also better able to accommodate a tying mechanism by which the diaphragm is held to the wobble plate to draw the diaphragm away from the pump casing during the intake cycle. Stretching and buckling are believed to also significantly impact on the longevity of more rigid diaphragms.

SUMMARY OF THE INVENTION

The present invention is directed to a peristaltic pump and diaphragm therefor.

In a first, separate aspect of the present invention, a pump includes a wobble plate and a pumping diaphragm associated with the wobble plate. An insert is embedded within the diaphragm and includes mounting posts extending from one side for association with the wobble plate. In a further detail of this aspect, the diaphragm may include a boss extending over the insert which mates with a channel on the surface of the wobble plate to assist in locating of the diaphragm.

In a second, separate aspect of the present invention, a pump employing a wobble plate and a pumping diaphragm associated with the wobble plate is employed with an insert within the diaphragm and extending from one side thereof to mount with the wobble plate. The insert is flexible in torsion and is strained from a relaxed position to an assembly with the wobble plate to insure ease of fabrication of the diaphragm.

In a third, separate aspect of the present invention, peristaltic pump diaphragms containing selected ones of the foregoing features are contemplated.

Thus, it is an object of the present invention to provide improved components and pumps using peristaltic motion. Other and further objects and advantages will appear hereinafter.

DETAILED DESCRIPTION OF THE PREFERRED EMBODIMENTS

Figure 1:
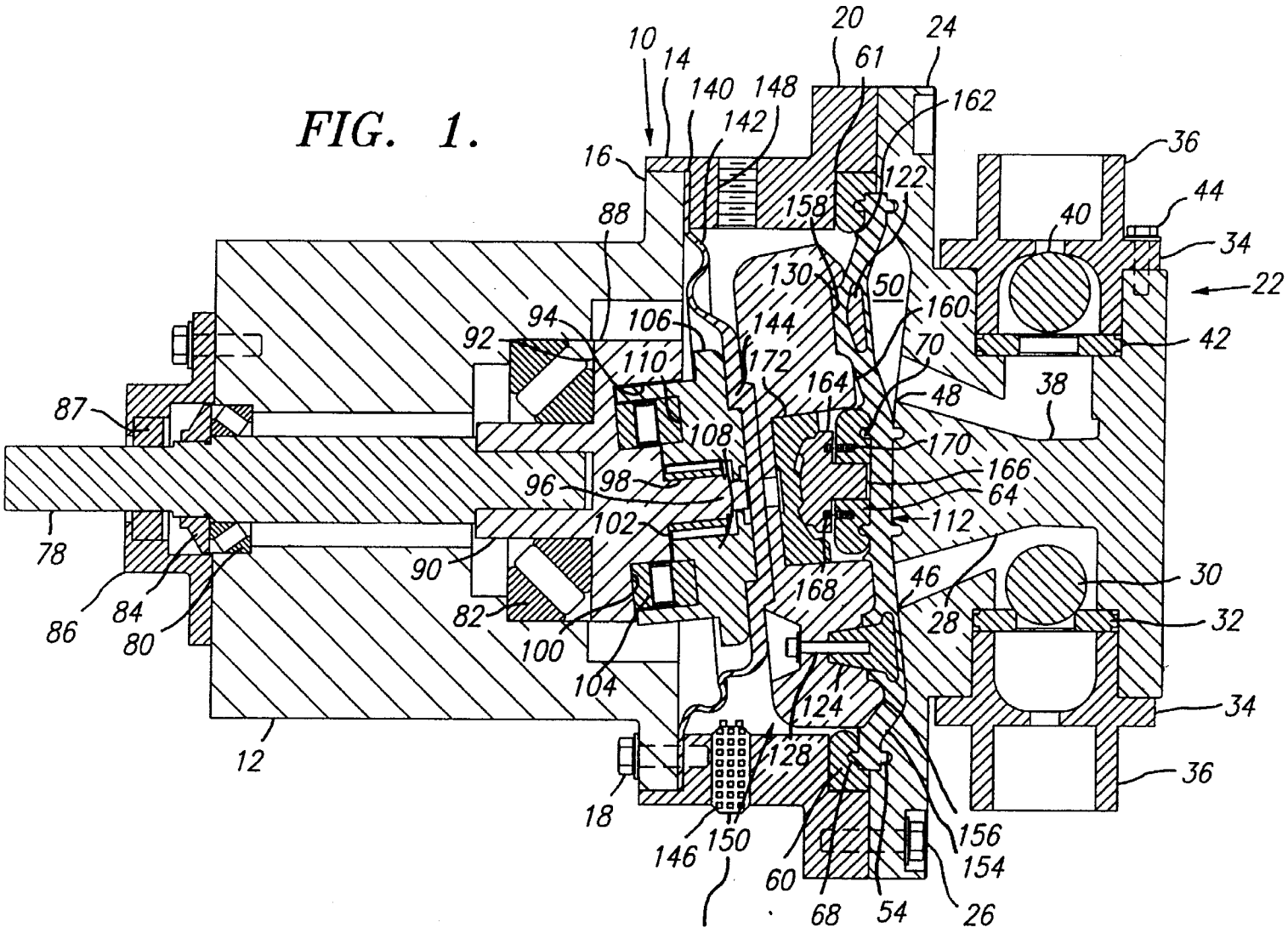
FIG. 1 is a cross-sectional elevation view of a first embodiment of the present invention.

Turning in detail to the drawings, FIG. 1 illustrates a first embodiment with a pump housing, generally designated 10. The pump housing 10 includes a shaft support portion 12 and a cylindrical backup chamber housing 14. The shaft support portion 12 is conveniently cylindrical and is shown to be thick walled in order that structural plastics or the like may be used. The portion 12 also includes a bore therethrough with appropriate countersunk portions to receive shaft mounting bearings. An annular flange 16 provides for attachment to the backup chamber housing 14 using fasteners 18. The backup chamber housing 14 is also thick walled for use of structural plastics. A countersunk portion receives the annular flange 16. An annular flange 20 provides for mounting at the far end of the backup chamber housing 14 from the attachment of the shaft support portion 12.

Attached to the backup chamber housing 14 at the annular flange 20 is a pump casing, generally designated 22. The pump casing includes a flange 24 for mounting with the annular flange 20 by means of fasteners 26. An inlet passage 28 is provided with a ball check valve 30 associated with a seat 32. The seat 32 is held in place by a retainer 34 having a nipple 36 to receive a conduit. An identical retainer 34 is associated with an outlet passage 38, ball check valve 40 and seat 42. Both of the retainers 34 are held in place by fasteners 44.

Figure 2:
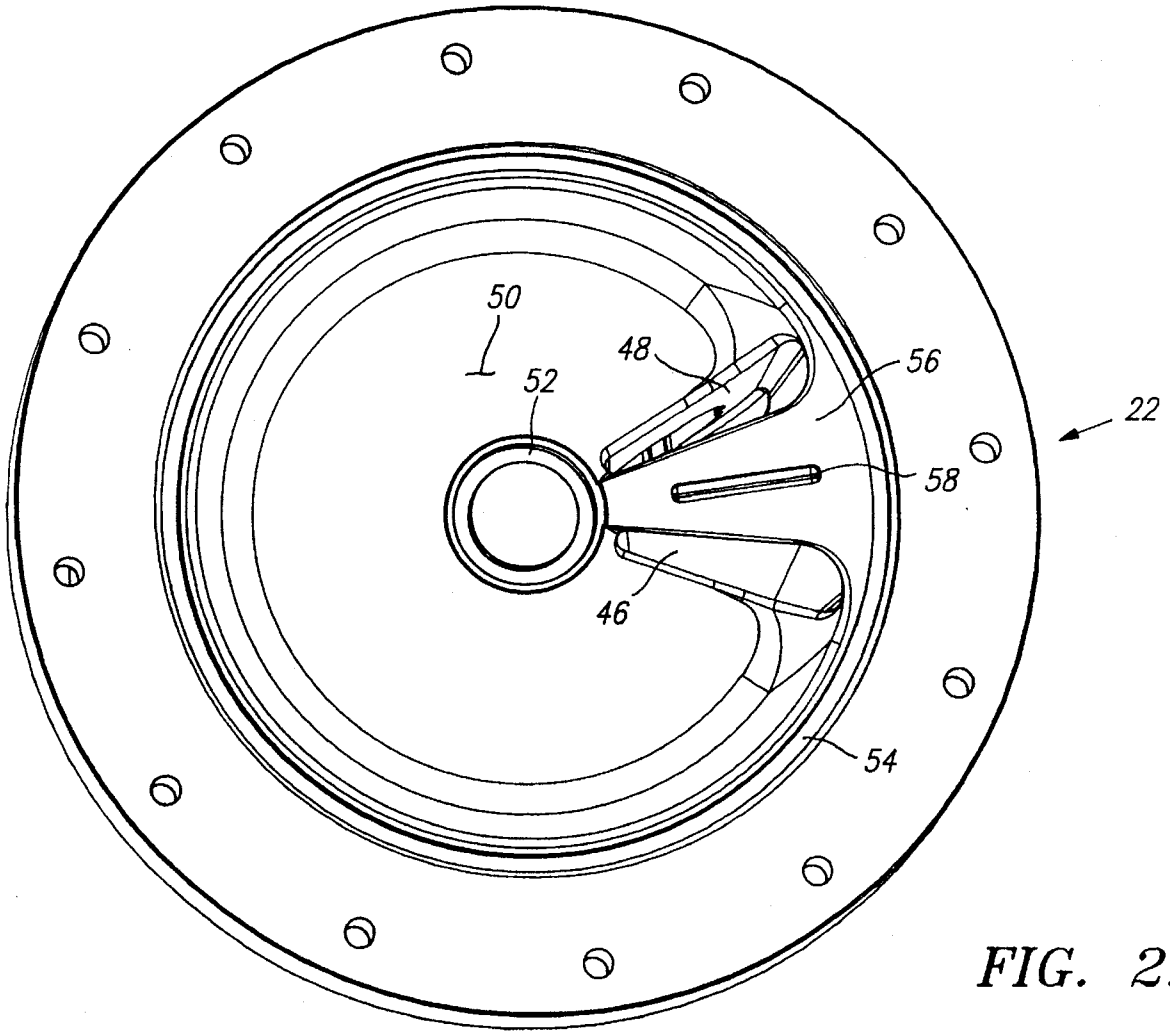
FIG. 2 is a plan view of the pump casing.
Figure 3:
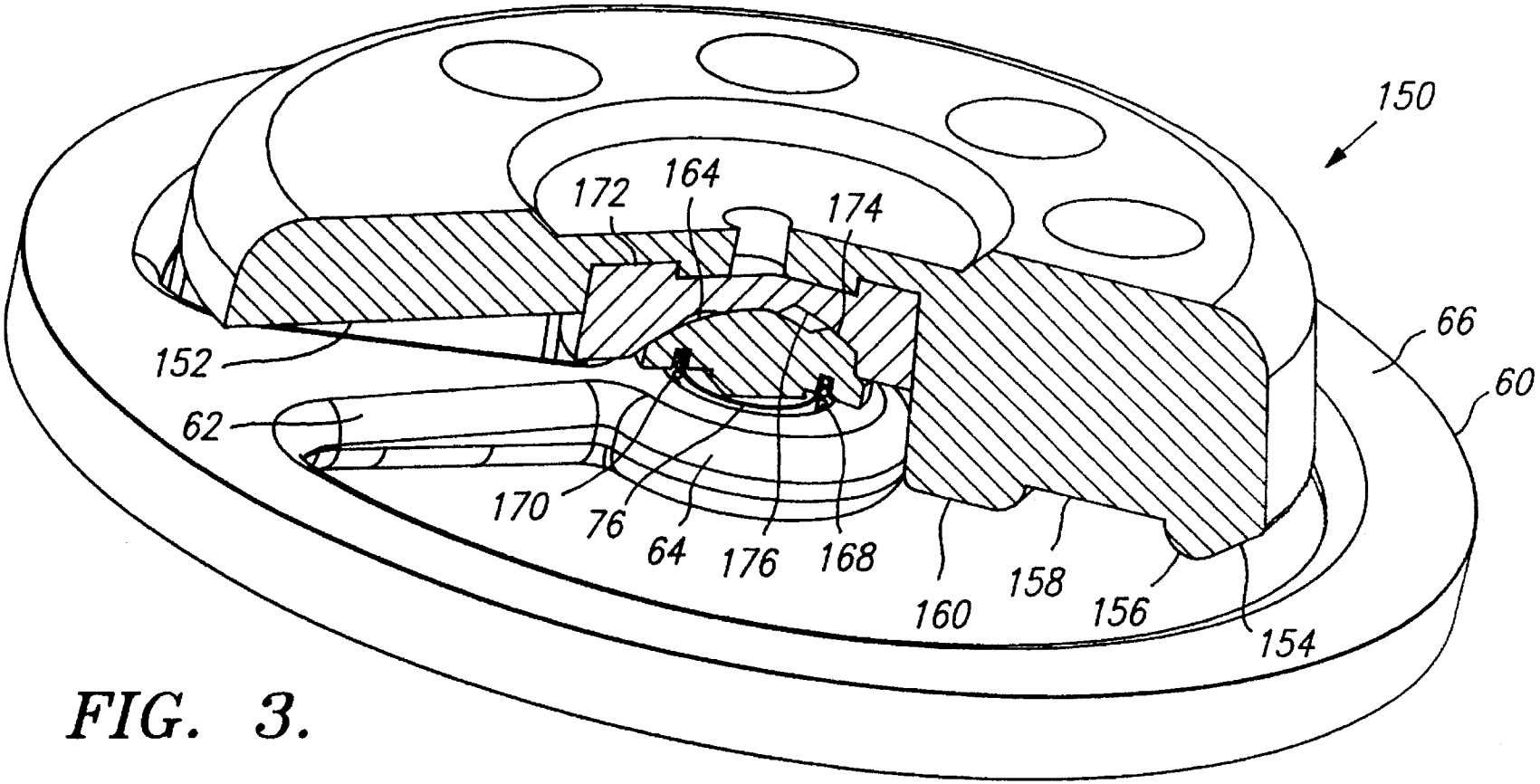
FIG. 3 is a partially cross sectioned oblique view of the wobble plate and mounting components.

The inlet passage 28 and outlet passage 38 extend to an inlet 46 and outlet 48, respectively, as best seen in FIG. 2. A pump chamber 50 is defined by a central dished portion of the pump casing 22. Located centrally of the pump chamber 50 is a sealing groove 52. A sealing groove 54 is also located about the periphery of the pump chamber 50. A ridge 56, as can best be seen in FIG. 2, extends between the inlet 46 and outlet 48. A groove 58 provides angular location for the diaphragm to be associated therewith.

Figure 4:
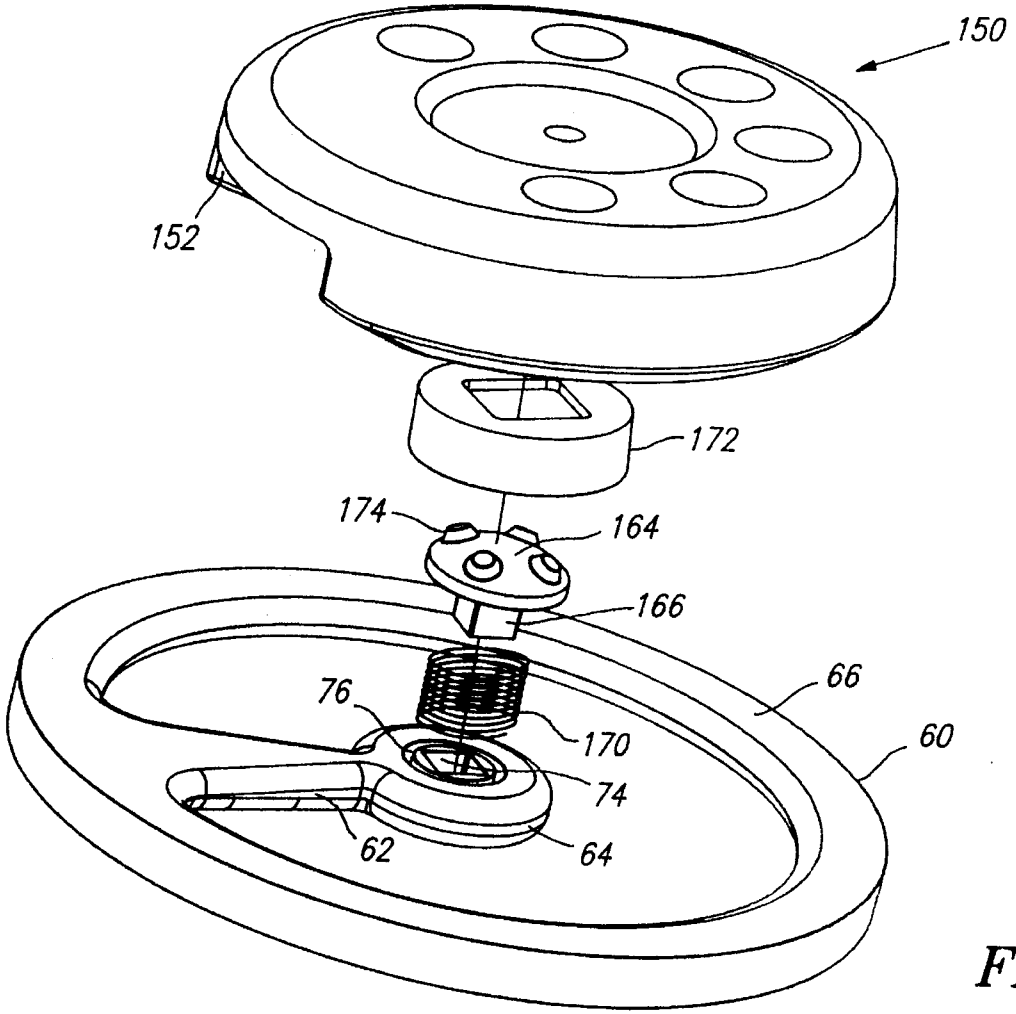
FIG. 4 is an exploded view of the components of FIG. 3.

Associated with the housing 10 is a diaphragm frame plate 60. The diaphragm frame plate 60 is set within a countersunk area of the backup chamber housing 14 inwardly of the annular flange 16 with a gasket 61 to seal between the plate 60 and the housing 14. The diaphragm frame plate 60, as best seen in FIG. 4, is generally ring shaped with an inwardly extending spoke 62 supporting a concentrically located hub 64. The ring portion 66 has a sealing groove 68 on its underside. The sealing groove 68 overlies the sealing groove 54 when the several parts are assembled. The hub 64 also includes a sealing groove 70 overlying the sealing groove 52 of the pump casing 22. A groove overlies the groove 58 in the pump casing 22, also for location of a diaphragm. The hub 64 includes a noncircular, in this case square, hole 74 extending therethrough. Outwardly of the hole 74 is a spring groove 76 conveniently circular.

Extending through the housing 10 is a drive shaft 78. The drive shaft 78 is rotatably mounted in thrust bearings 80 and 82. A lock nut 84 places compression on the bearings 80 and 82. A retainer 86 is fastened about the shaft 78 to the end of the housing 10 to enclose a seal 87.

Fixed to rotate with the drive shaft 78 is a rotor 88. The rotor 88 provides a cylindrical surface 90 and a shoulder 92 to receive the thrust bearing 82. As the rotor 88 is asymmetrical in shape, a shape is preferably employed which places the center of gravity on the axis of rotation. A circular channel 94 extends about the opposite end of the rotor 88 from its attachment with the drive shaft 78. This annular channel 94 is at an angle of 6° to a plane perpendicular to the axis of rotation of the rotor 88. Concentric with the circular channel 94 is a rotor shaft 96. The rotor shaft 96 has a retaining cylindrical surface 98. The bottom of the circular channel 94 has a drive surface 100. The retaining surface 98 and drive surface 100 present a drive coupling in association with a roller bearing 102 and a thrust bearing 104, respectively.

A driven plate 106 includes a retained cylindrical surface 108 and a driven surface 110 to receive the drive coupling including the roller bearing 102 and thrust bearing 104, respectively. Although symmetrical about a center axis, the driven plate 106 will typically not rotate with the rotor 88 when the rotor is driven by the drive shaft 78. However, a nutation, or wobble motion, is imparted by the angled drive coupling as it rotates relative to the driven plate 106.

A pump diaphragm, generally designated 112, is retained between the housing 10 and the pump casing 22. The diaphragm 112 has no openings therethrough. About its outer periphery are sealing ridges 114 and 116 on either side of the diaphragm sheet. These sealing ridges 114 and 116 engage the sealing grooves 54 and 68, respectively. Thus, the outer periphery of the diaphragm 112 is held and sealed directly between the pump casing 22 and the ring portion 66 of the diaphragm frame plate 60. Similarly, at the center of the diaphragm 112, the circular sealing ridges 118 and 120 overlay one another on either side of the diaphragm sheet so as to meet with sealing grooves 52 and 70, respectively. The hub 64 of the diaphragm frame plate 60 and the center portion of the pump chamber surface of the pump casing 22 retain and seal the inner part of the diaphragm. Six sealing ridges 121 are located between the inlet and outlet. These ridges 121 extend outwardly from the diaphragm and are of small cross section so that they are easily deformed to conform to the pump casing 22 for sealing. In its relaxed state, the diaphragm, as fabricated, lies in immediate juxtaposition with the pump chamber surface 50 of the pump casing 22. The relaxed position of the diaphragm is illustrated in the cross section of FIG. 8. This corresponds to the orientation of any point on the diaphragm as it exists in operation at its closest approach to the pump casing 22.

Figure 7:
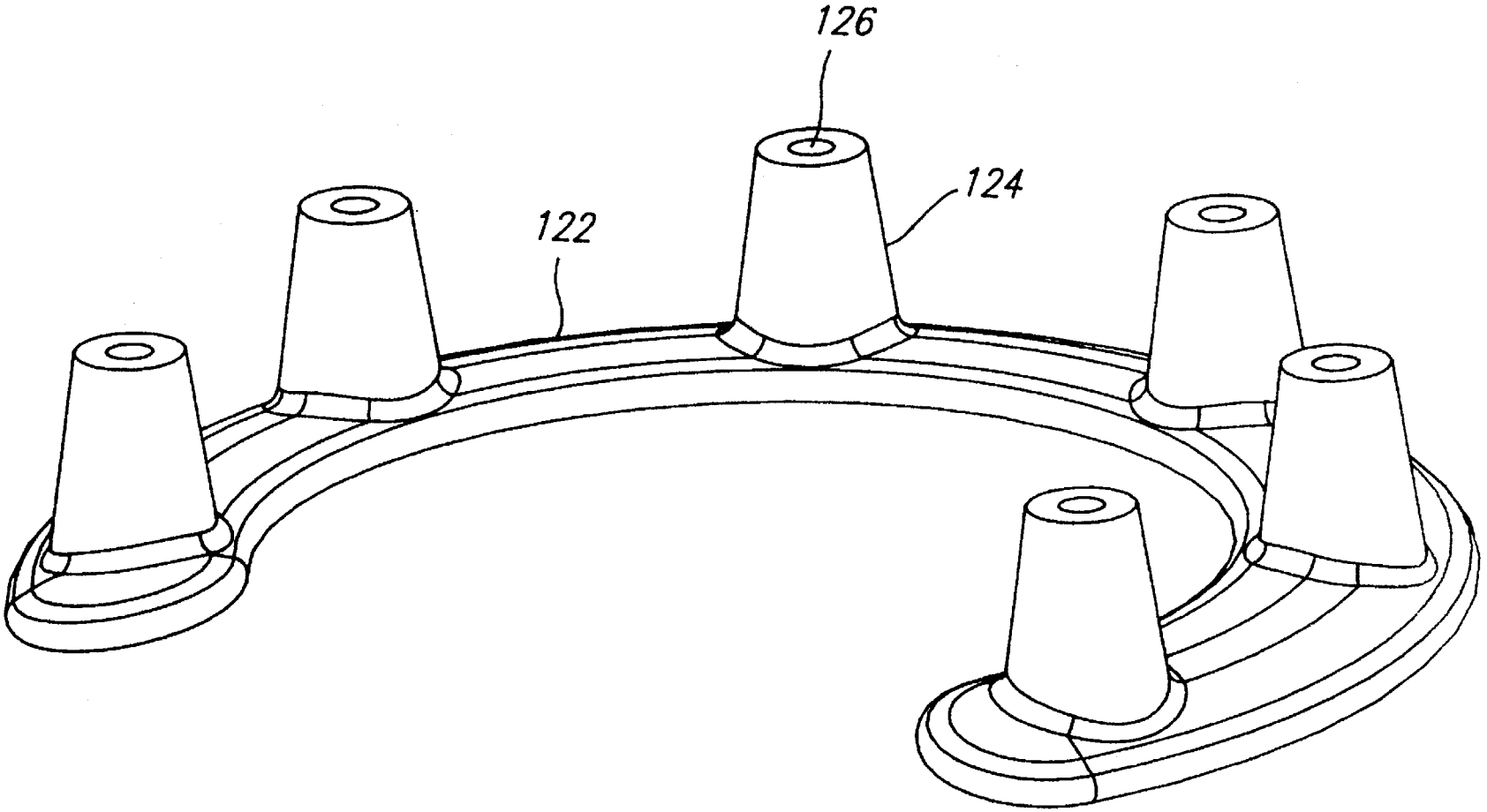
FIG. 7 is a perspective view of the insert.

Embedded within the diaphragm 112 is an insert 122. The insert 122 is shown by itself in FIG. 7. The body of the insert 122 forms an arc of a circle oblong in minor cross section and has a mounting extending from one side thereof. The mounting includes a plurality of mounting posts 124. The mounting posts 124 have attachment holes 126 to receive fasteners 128. The insert 122 is flexible in torsion about axes normal to the minor cross section of the body of the insert forming the arc of a circle. The mounting posts 124 are shown in the relaxed position in FIG. 7. However, when assembled in the pump, the distal ends of the mounting posts are rotated inwardly a small degree toward one another and, thereby, subjected to torsional strain. This arrangement eases design in fabrication of the components.

Figure 5:
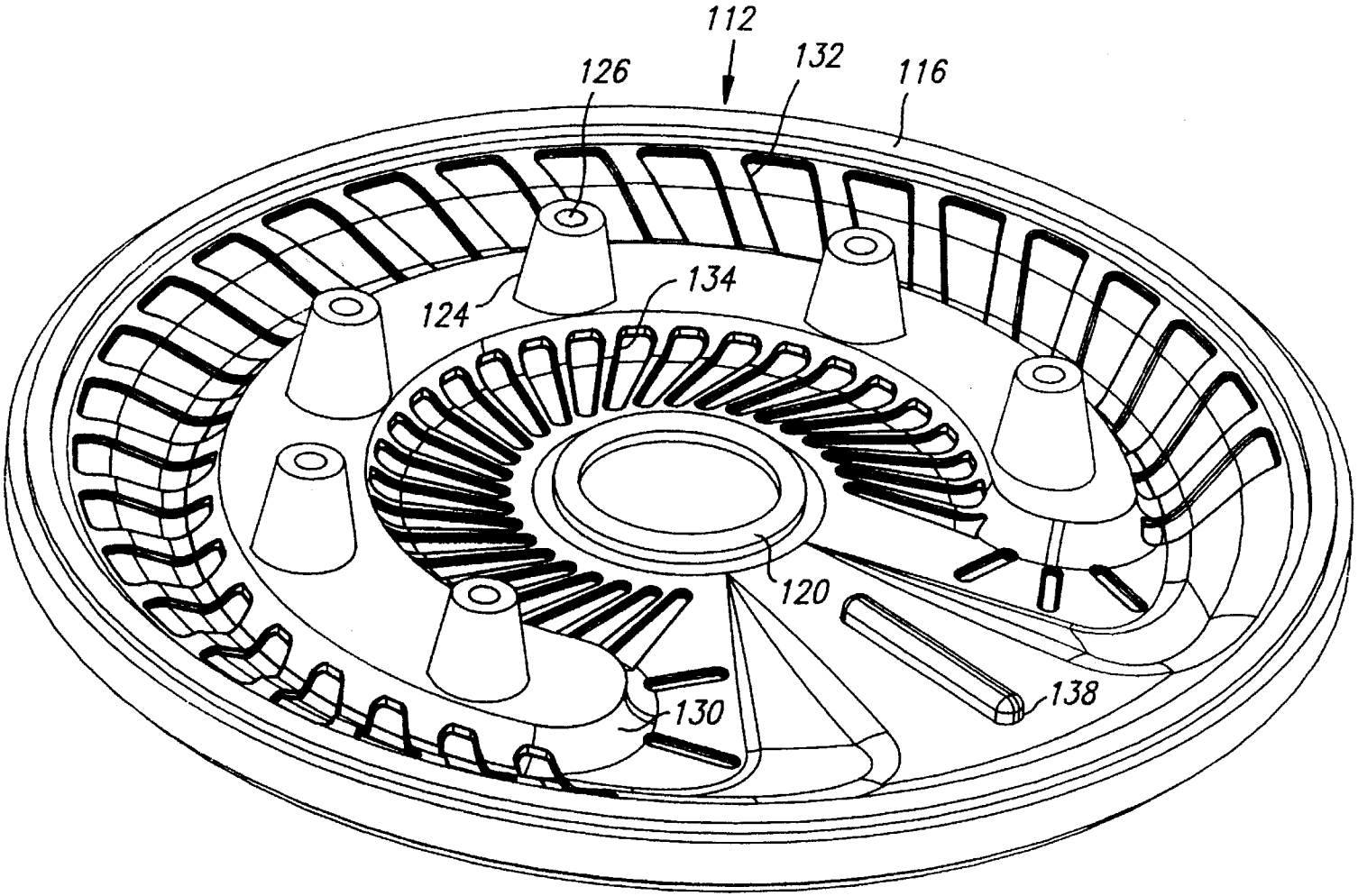
FIG. 5 is a top perspective view of the diaphragm.
Figure 6:
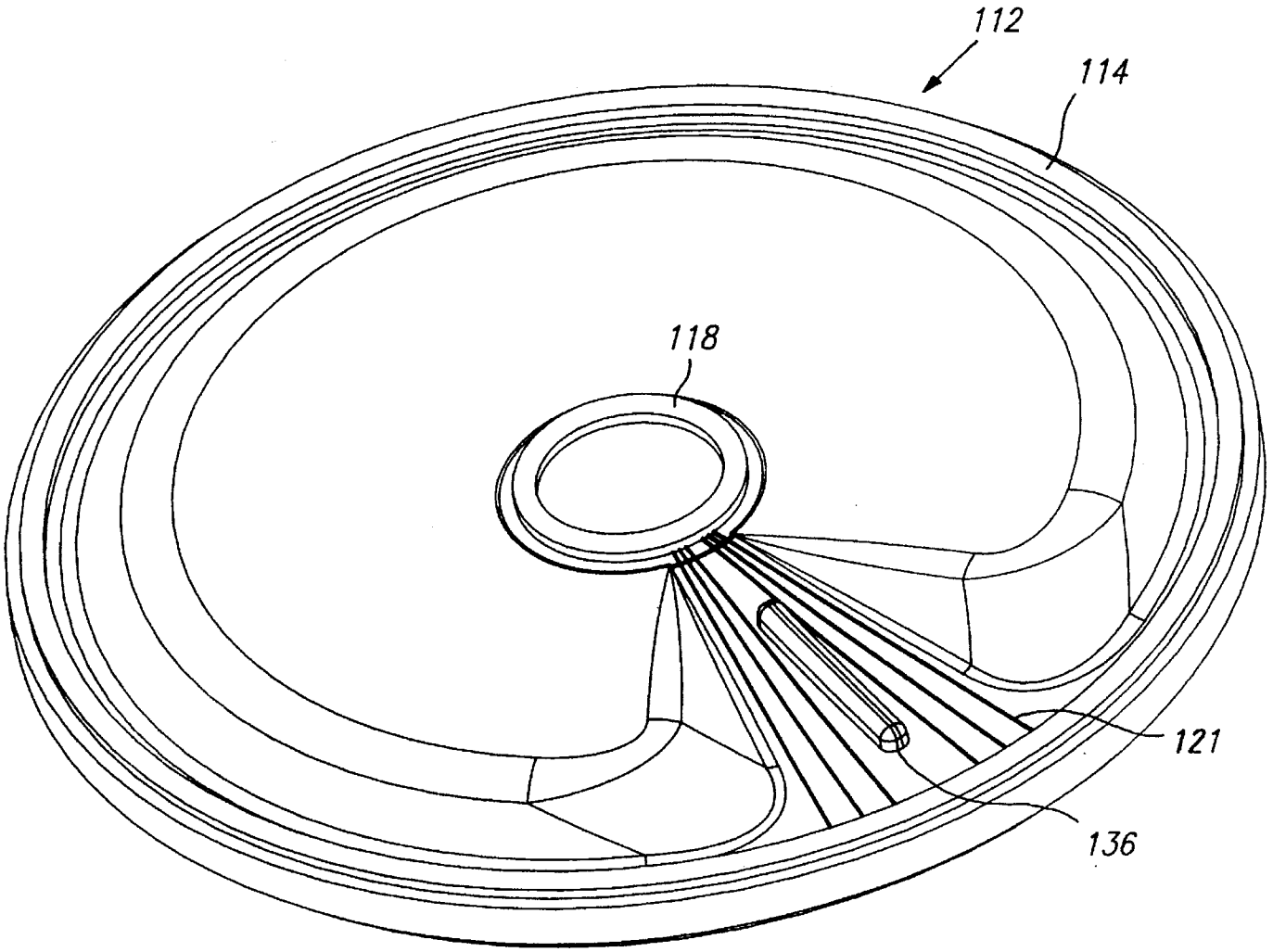
FIG. 6 is a bottom perspective view of the diaphragm.

Overlaying the insert 122 in the pump diaphragm 112 is a boss 130 forming an arc of a circle. The boss 130 surrounds the mounting post 124. Additional support is provided by the boss 130 to prevent extraction of the insert 122 during extended operation. Outwardly of the boss 130 are cavities 132. The cavities 132 may be best illustrated in FIG. 5. They are arranged at an acute angle to the radial direction and have a greater width in the circumferential direction of the diaphragm 112 than the distance between adjacent ones of the cavities 132. This configuration is designed to assist in the bending and flexing of the diaphragm 112 so as not to form kinks and high stress points. A second set of cavities 134 are provided inwardly of the boss 130 as also can best be seen in FIG. 5. Again, the cavities 134 are at an acute angle to the radial direction of the diaphragm 112 and are wider than the adjacent spaces between the cavities which operate as stronger ribs. The diaphragm 112 also has locating ribs 136 and 138 located on either side of the diaphragm to cooperate with the grooves on the pump casing 22 and diaphragm frame plate 60 for locating the components together in angular alignment.

Associated with the driven plate 106 and the backup chamber housing 14 is a backup diaphragm 140. The backup diaphragm 140 is continuous without holes within its periphery except to accommodate the fasteners 18. The backup diaphragm 140 has circular corrugations 142 in a thin walled annular section to insure significant flexing capability. Centrally located on the backup diaphragm 140 is a resilient coupling 144 defined by a thicker portion of the diaphragm sheet shaped to mate with the driven plate 106. Cavities 145 provide greater resilience to the resilient coupling 144.

The backup diaphragm 140 is designed to define a backup cavity behind the pump diaphragm 112. If the pump diaphragm 112 ruptures, the cavity between the pump diaphragm 112 and the backup diaphragm 140 may receive the pumped liquid before shutdown occurs. The backup diaphragm 140 is displaced from the pump diaphragm 112 which is advantageous for avoiding the friction normally associated with the use of backup diaphragms on diaphragm pumps. A sensor 146 is mounted in a port 148. A second port 148 is illustrated. The ports may be used for flushing or for drainage off to a larger reservoir.

Located between the pump diaphragm 112 and the backup diaphragm 140 is a wobble plate, generally designated 150. The wobble plate is also shown to be relatively thick in cross section as the entire pump is designed to be made out of structural plastics. The surface of the wobble plate 150 adjacent the drive coupling is configured to mate with the resilient coupling 144 formed by the center of the backup diaphragm 140. The wide surface defined by the resilient coupling 144 provides for a transmission of significant force without high pressures through the elastomeric material. The thickness of the resilient coupling 144 accommodates the pumping of small solids and some misalignment of the components. The thickness and resiliency of this material is best determined to accommodate the design tolerances and intended use of the device.

The surface of the wobble plate 150 most adjacent the pump diaphragm 112 is configured to accommodate the diaphragm 112 and to present an appropriate surface which will not stress the diaphragm and will also provide significant backup to the diaphragm in strain resulting from liquid pressures within the pump. The wobble plate 150 includes a central cavity 152 which extends outwardly to the periphery of the wobble plate 150 so as to accommodate the spoke 62 of the diaphragm frame plate 60. A peripheral edge to the lower surface may thus be defined as circumferential arcs of a circle with somewhat radial transition lines extending between respective ends of the arcs. Within this defined peripheral edge of the lower surface, the wobble plate 150 operates to alternately press against and draw away from the pump diaphragm 112 in nutating. But for the inner portion of the peripheral edge, a conical peripheral surface 154 extends to the peripheral edge. Inwardly of the conical peripheral surface 154 is a rounded ridge 156. Inwardly of the ridge 156 is a channel 158 coextensive with the boss 130 of the pump diaphragm 112. The boss 130 and the channel 158 provide a fit which is in interference. Inwardly of the channel 158 is a flat, circular surface 160 terminating at the inner portion of the peripheral edge associated with the central cavity 152.

The cooperation between the wobble plate 150 and the pump diaphragm 112 is such that the pump diaphragm is never drawn into a condition by the geometry and movement of the wobble plate where the sheet of the diaphragm must stretch in tension. The relaxed condition of the diaphragm 112 when formed gives it the same surface shape as the underside of the wobble plate 150 at the point that is the closest to the pump casing 22. Thus, the cone angle is greater on the diaphragm surface and on the pump casing 22 than on the wobble plate 50 at the conical surface 154. By conforming to the rounded ridge 156 as well as the conical peripheral surface 154, the diaphragm comes the closest to being tensioned by the geometry of the pump at the lowest point in the nutation of the wobble plate, seen on the bottom in FIG. 1. As the point of the wobble plate 150 illustrated in the bottom of FIG. 1 moves away from the pump casing 22, the pump diaphragm 112 may leave the conical peripheral surface 154 and then unwrap from the rounded ridge 156. Thus, the pump diaphragm 112 has some slack between the boss portion 130 and the outer periphery of the diaphragm.

This slack reaches a maximum at a midpoint in the movement of the point on the wobble plate and then the slack is removed as the point on the wobble plate reaches its greatest distance from the pump casing 22 as shown at the top of FIG. 1. Because of the liquid pressure on the underside of the pump diaphragm 112, the pump diaphragm 112 is believed not to leave the conical peripheral surface 154 immediately upon movement of the wobble plate 150 at its point of first movement away from the pump casing 22. Inwardly of the boss 130, the pump diaphragm 112 is subject to far less movement and unsupported forces.

To assist in accommodating the liquid pressures imposed on the pump diaphragm 112, a ridge 162 extends about the surface of the pump diaphragm 112 adjacent to the wobble plate 150. This ridge is immediately adjacent the peripheral edge as described above when the wobble plate 150 is in position to touch the diaphragm 112. The ridge 162 is also immediately adjacent the inner periphery of the diaphragm frame plate 60 including the ring portion 66, the spoke 62 and the hub 64. Again, this contact is when the diaphragm is moved away from the pump casing 22 by nutation of the wobble plate 150. The outer portion of the peripheral edge of the wobble plate 150 is designed to come as close to the inner edge of the diaphragm frame plate 60 as possible. This reduces the amount of unsupported pump diaphragm 112 when it is under pressure. The upstanding ridge on the pump diaphragm 112 extending to between these portions is configured such that it selectively contacts both the peripheral edge of the wobble plate 150 and the inner edge of the diaphragm frame plate 60. This contact provides additional stiffness in that the contact of the ridge 162 with these elements prevents further local rotation of the diaphragm as it expands under liquid pressure at unsupported areas of the diaphragm.

Figure 8:
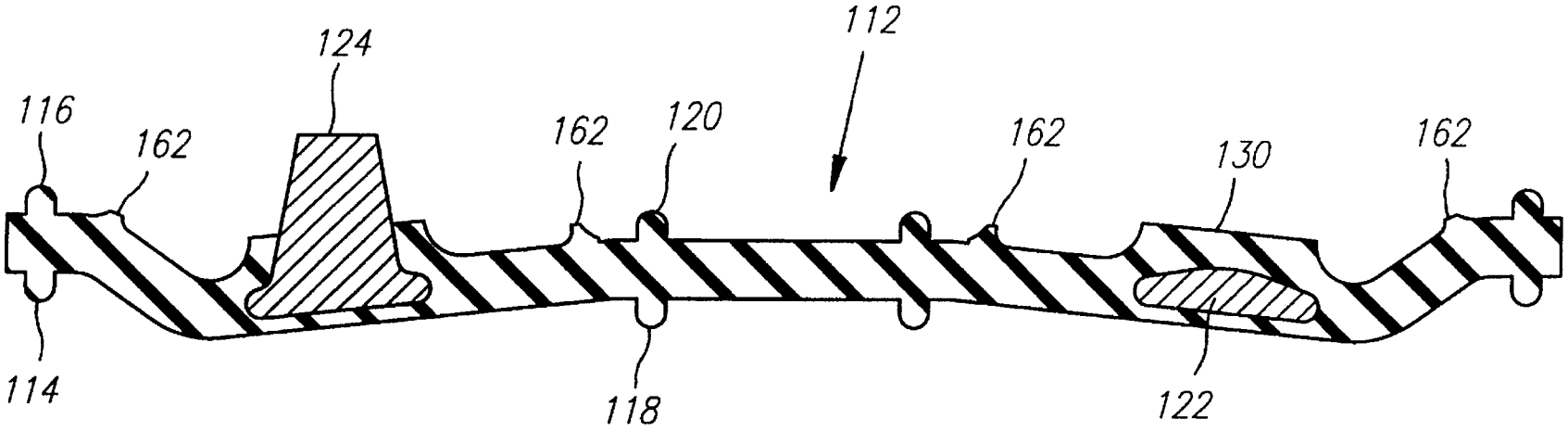
FIG. 8 is a cross-sectional view of the diaphragm.
Figure 9:
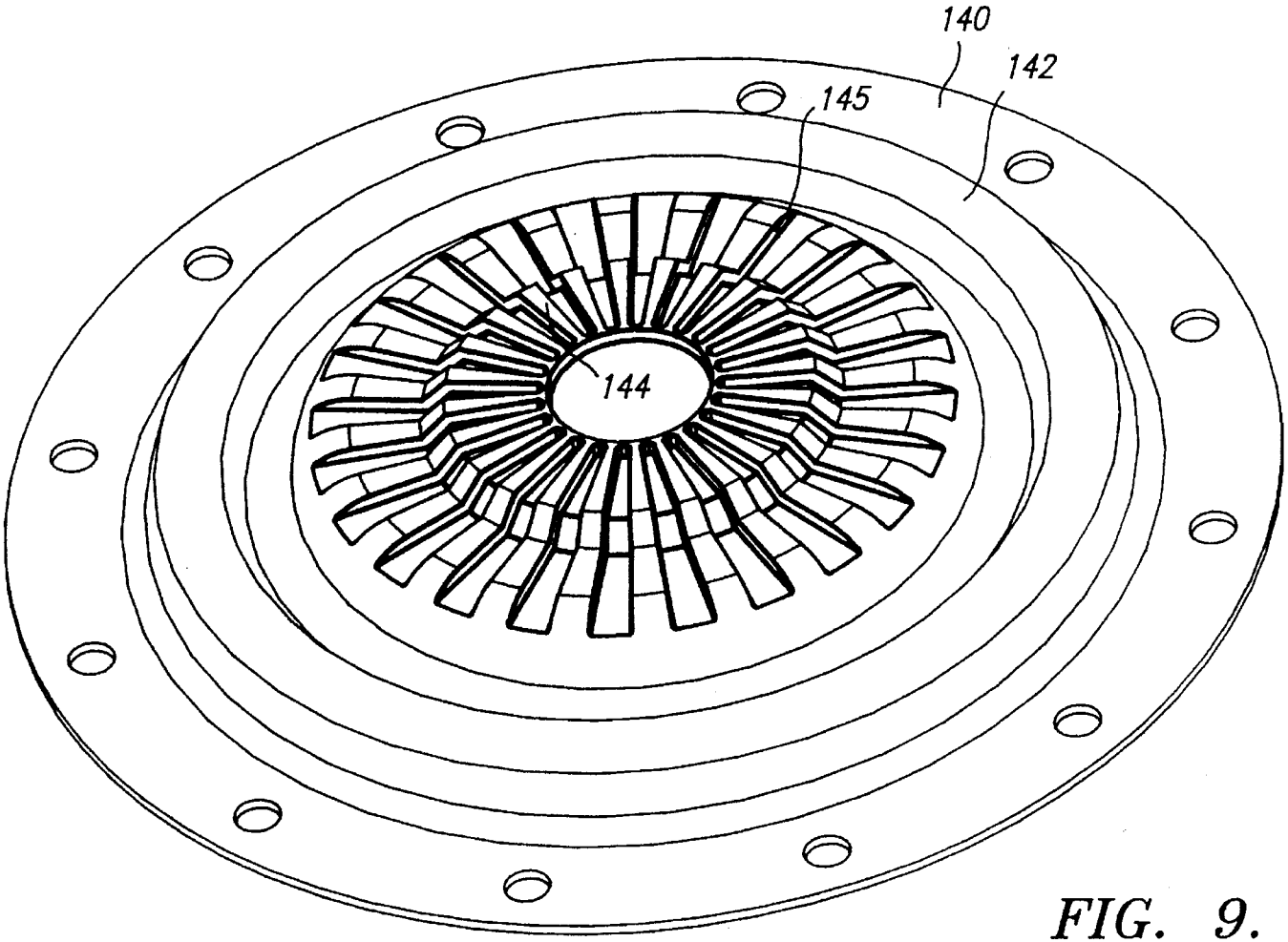
FIG. 9 is a perspective view of the backup diaphragm.
Figure 10:
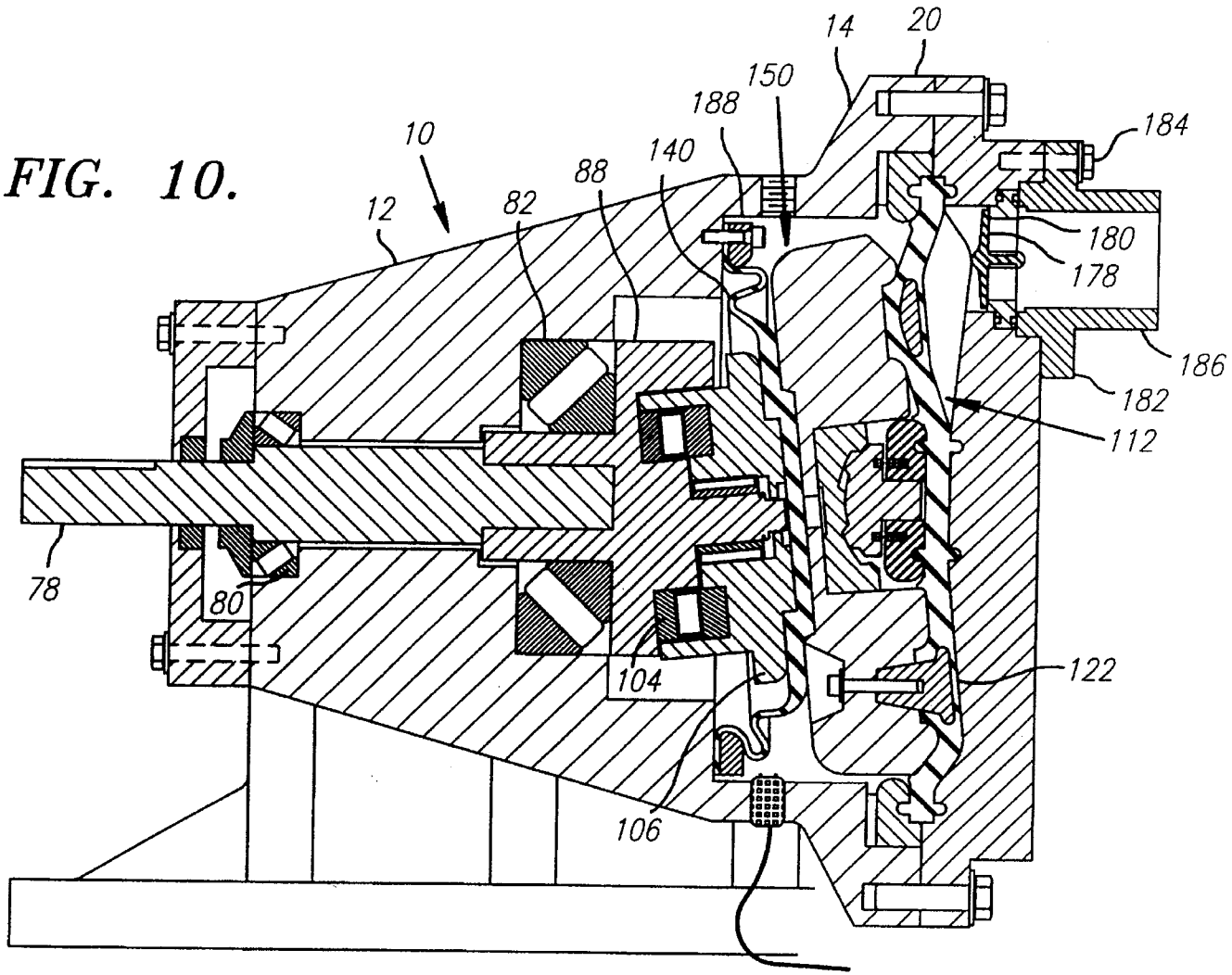
FIG. 10 is a cross-sectional elevation view of a second embodiment.

The wobble plate 150 both supports the diaphragm 112 and draws it away from the pump casing 22 in the continuing nutation of the wobble plate about the pump axis of rotation. To draw the diaphragm away from the pump casing 22, the mounting posts 124 of the insert 122 are fixed by the fasteners 128 to the wobble plate 150. Because the insert 122 and particularly the mounting posts 124 are associated with the boss 130, added structural support for the diaphragm is provided. This is further increased by the channel 158 into which the boss 130 is tightly drawn by the fasteners 128. As can be seen in FIGS. 1, 8 and 10, the insert 122 spans across the width of the boss 130. As a result, the boss 130 creates a thicker portion above the insert than the portion to either side of the boss above the insert. In other words, the distance from the insert body to the surface through which the mounting posts 124 extend adjacent to either side of the boss 130 is less than the distance from the insert body through the boss to the same surface. Consequently, the channel 158 retains the edges of the boss 130 from flexing outwardly away from the mounting posts 124.

The wobble plate 150 is mounted to the housing 10 by means of a mount 164. The mount 164 includes a square mounting post 166 to locate the mount 164 in the hub 64. A circular spring groove 168 overlies the spring grove 76 so as to accommodate in compression a spring 170. This provides resilience to the mount 164 to accommodate movement of the wobble plate 150 to overcome misalignment or solids within the pump cavity. Thus, the wobble plate 150 is retained between the resilient coupling 144 of the backup diaphragm 140 and the mount 164 for nutation and resilient adjustments as may be necessary.

The mount 164 includes a spherical surface. Located within the central cavity 152 of the wobble plate 150 is an insert 172 which has a concave spherical surface to mate with the spherical surface of the mount 164. The insert 172 is keyed to the wobble plate 150 to prevent rotation. Pins 174 are arranged on the spherical surface of the mount 164. These pins are preferably circular in cross section and tapered along their length. Cavities 176 corresponding to the pins 174 are provided on the spherical concave surface of the insert 172 of the wobble plate 150. The cavities 176 are also tapered and conveniently circular in cross section. They are larger and more tapered than the pins 174 so as to accommodate the 6° wobble of the wobble plate 150. Because the insert 172 and the mounts 164 are fixed from rotation relative to the housing 10, the pins 174 and cavities 176 provide a coupling between the housing and the wobble plate 150 so that the wobble plate 150 is prevented from rotating or attempting to rotate which would place the diaphragm 112 in further stress. The overall arrangement of the mount 164 is such that the center of curvature of the spherical surface thereof is located on the axis of rotation of the pump and is preferably within the diaphragm.

In a second embodiment as illustrated in FIG. 10, flapper valves 178 are presented at the inlet and outlet of the pump cavity. The flapper valves 178 are associated with seats 180. Inserts 182 held in place by fasteners 184 provide nipples 186 for receipt of conduits to and from the pump. The housing 10 is also shown with the shaft support portion 12 and the chamber housing 14 in one piece. A diaphragm retainer 188 locks the backup diaphragm in place.

Figure 11:
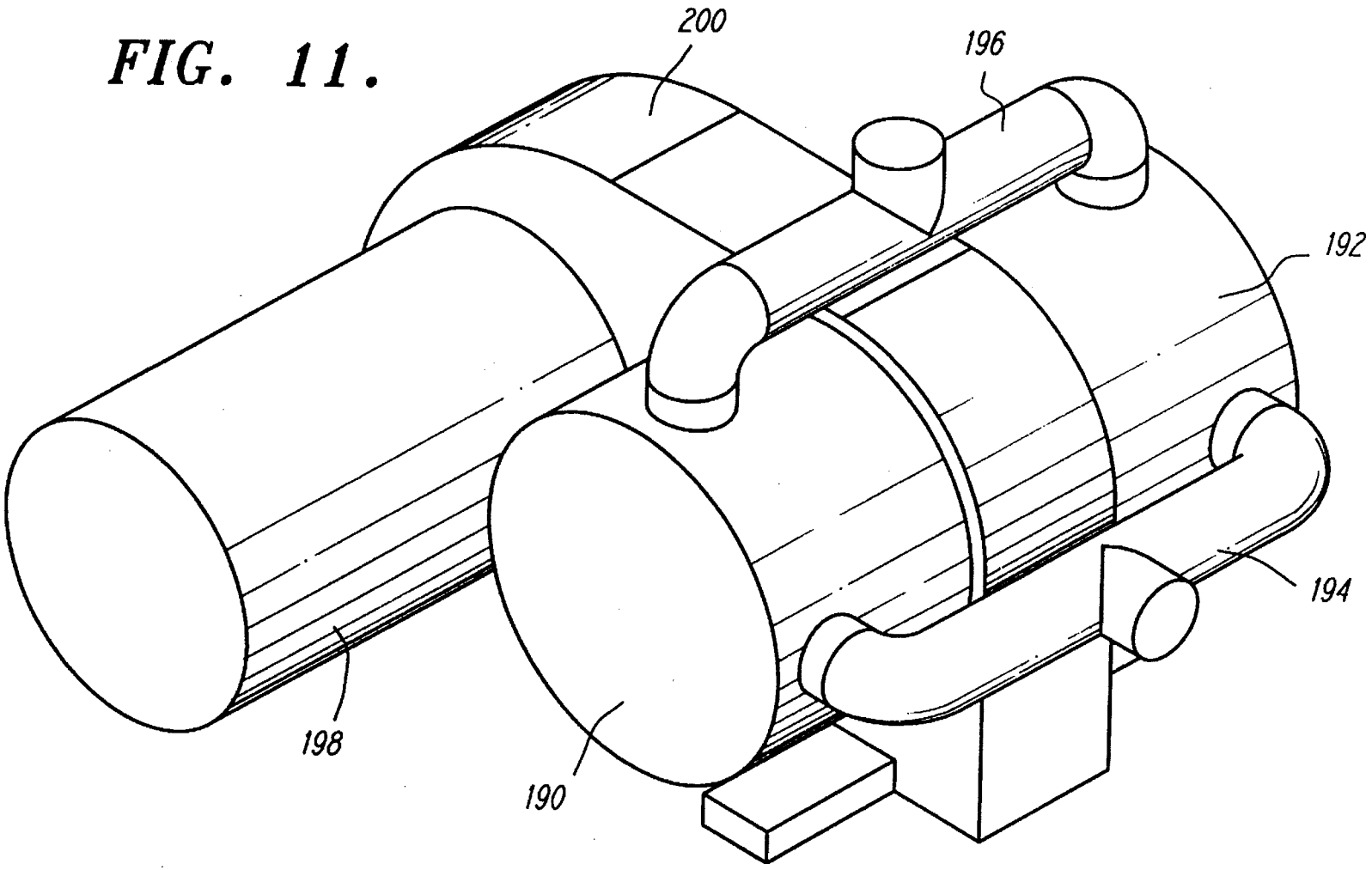
FIG. 11 is a perspective view of a two diaphragm embodiment with a drive.

In FIG. 11, a double diaphragm pump is illustrated which substantially is two pumps of the first or second embodiment placed end to end with a common or coupled shaft. Illustrated are two pump units 190 and 192 with a common inlet manifold 194 and a common outlet manifold 196. A motor 198 drives a common shaft through a belt, chain or gear located in a drive housing 200. The wobble plates are preferably arranged at a phase angle of 180° to reduce surge.

Thus, an improved peristaltic pump has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A pump diaphragm for a pump having a wobble plate, comprising a diaphragm;

an insert including an elongate body, oblong in minor cross section, extending in an arc with the major dimension of the oblong cross section lying substantially in the plane of the arc, the body being embedded in the diaphragm, and mounting elements mutually displaced and extending from one side of the body substantially perpendicularly to the plane of the arc and to outwardly of the diaphragm on a first side of the diaphragm, the diaphragm including a boss overlying the body throughout the length of the body with the mounting elements extending through the boss.

2. The pump diaphragm of claim 1, the body being flexible in torsion about axes normal to the oblong minor cross section, allowing the distal ends of the mounting elements to be drawn toward one another.

3. A pump diaphragm for a pump having a wobble plate, comprising an insert including an elongate body extending in an arc and mounting elements mutually displaced and extending from a first side of the body;

a diaphragm embedding the body of the insert and including a boss on a first surface of the diaphragm overlying the first side of the body throughout the length of the body with the mounting elements extending from the diaphragm through the boss, the distance from the body to the first surface of the diaphragm adjacent either side of the boss being less than the distance from the body through the boss.

4. The pump diaphragm of claim 3, the body being flexible in torsion about axes normal to the minor cross section of the body, allowing the distal ends of the mounting elements to be drawn toward one another.

5. A pump diaphragm for a pump having a wobble plate, comprising an insert including an elongate body, oblong in minor cross section, extending in an arc with the major dimension of the oblong cross section lying substantially in the plane of the arc, and mounting elements mutually displaced and extending from a first side of the body substantially perpendicularly to the plane of the arc;

a diaphragm embedding the body of the insert and including a boss on a first surface of the diaphragm overlying the first side of the body throughout the length of the body with the mounting elements extending from the diaphragm through the boss, the distance from the body to the first surface of the diaphragm adjacent either side of the boss being less than the distance from the body through the boss.

6. A pump diaphragm for a pump having a wobble plate, comprising an insert including an elongate body, oblong in minor cross section, extending in an arc with the major dimension of the oblong cross section lying substantially in the plane of the arc, and mounting elements mutually displaced and extending from a first side of the body substantially perpendicularly to the plane of the arc, the body being flexible in torsion about axes normal to the minor cross section of the body, allowing the distal ends of the mounting elements to be drawn toward one another;

a diaphragm embedding the body of the insert and including a boss on a first surface of the diaphragm overlying the first side of the body throughout the length of the body with the mounting elements extending from the diaphragm through the boss, the distance from the body to the first surface of the diaphragm adjacent either side of the boss being less than the distance from the body through the boss.

7. A pump comprising a wobble plate including a channel extending in an arc;

a diaphragm;

an insert including an elongate body, oblong in minor cross section, extending in an arc with the major dimension of the oblong cross section lying substantially in the plane of the arc, the body being embedded in the diaphragm, and mounting elements mutually displaced and extending from one side of the body substantially perpendicularly to the plane of the arc and to outwardly of the diaphragm on a first side of the diaphragm and engaged with the wobble plate, the diaphragm including a boss overlying the body throughout the length of the body with the mounting elements extending through the boss, the boss lying within the channel.

8. The pump of claim 6, the body being flexible in torsion about axes normal to the oblong minor cross section, the distal ends of the mounting elements being drawn toward one another when attached to the wobble plate.

9. The pump of claim 6, the boss being in interference fit with the channel.

10. The pump of claim 6, the distance from the body to the first surface of the diaphragm adjacent either side of the boss being less than the distance from the body through the boss.

11. A pump comprising a wobble plate having a channel;

an insert including an elongate body extending in an arc and mounting elements mutually displaced and extending from a first side of the body and being attached to the wobble plate;

a diaphragm embedding the body of the insert and including a boss on a first surface of the diaphragm overlying the first side of the body throughout the length of the body with the mounting elements extending from the diaphragm through the boss, the boss lying in the channel, the distance from the body to the first surface of the diaphragm adjacent either side of the boss being less than the distance from the body through the boss.

12. The pump of claim 11, the body being flexible in torsion about axes normal to the minor cross section of the body, allowing the distal ends of the mounting elements to be drawn toward one another when attached to the wobble plate.

* * * * *

UNITED STATES PATENT AND TRADEMARK OFFICE

CERTIFICATE OF CORRECTION

PATENT NO. : 5,529,468

DATED : June 25, 1996

INVENTOR(S) : ALAN D. TUCK, JR.

It is certified that error appears in the above-indentified patent and that said Letters Patent is hereby corrected as shown below:

Column 8,

In claim 8, line 1, delete "6", and insert therefor -- 7 --.

In claim 9, line 1, delete "6", and insert therefor -- 7 --.

In claim 10, line 1, delete "6", and insert therefor -- 7 --.

Signed and Sealed this

Tenth Day of September, 1996

*Attest:*

Bruce Lehman

BRUCE LEHMAN

*Attesting Officer*

*Commissioner of Patents and Trademarks*